US006553586B1

(12) United States Patent
Lin

(10) Patent No.: US 6,553,586 B1
(45) Date of Patent: Apr. 29, 2003

(54) FOLDING BED FRAME

(76) Inventor: Eric Lin, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/036,177

(22) Filed: Dec. 26, 2001

(51) Int. Cl.[7] ..... A47C 17/72; A47C 17/64
(52) U.S. Cl. ..... 5/117; 5/114
(58) Field of Search ..... 5/110, 111, 112, 5/114, 116, 117, 174, 177, 179, 310, 312, 314.1

(56) References Cited

U.S. PATENT DOCUMENTS

| | | | | | |
|---|---|---|---|---|---|
| 198,869 | A | * | 1/1878 | Bradley | 5/117 |
| 952,214 | A | * | 3/1910 | Rasmussen | 5/117 |
| 1,003,801 | A | * | 9/1911 | Rodwick | 5/114 X |
| 1,170,229 | A | * | 2/1916 | Ferguson | 5/117 |
| 1,507,906 | A | * | 9/1924 | Cable | 5/117 |
| 1,518,386 | A | * | 12/1924 | Brower | 5/117 |
| 1,602,115 | A | * | 10/1926 | Malis | 5/114 |
| 1,608,924 | A | * | 11/1926 | Brown | 5/116 X |
| 1,654,529 | A | * | 1/1928 | Cable | 5/117 |
| 1,664,059 | A | * | 3/1928 | Cable | 108/118 |
| 1,671,638 | A | * | 5/1928 | Goldwyn | 5/117 |
| 1,696,245 | A | * | 12/1928 | Manly | 5/111 X |
| 1,787,566 | A | * | 1/1931 | Brown | 5/117 |
| 1,806,358 | A | * | 5/1931 | Manly | 5/117 |
| 2,075,796 | A | * | 4/1937 | Baker | 5/117 X |
| 2,464,863 | A | * | 3/1949 | Hoard | 5/110 |
| 2,508,254 | A | * | 5/1950 | Ham | 5/110 X |
| 2,591,551 | A | * | 4/1952 | Kaplan | 5/110 |
| 2,637,857 | A | * | 5/1953 | Isaacson | 5/110 X |
| 4,595,232 | A | * | 6/1986 | Glenn et al. | 5/112 X |
| 5,555,576 | A | * | 9/1996 | Kim | 5/114 |

FOREIGN PATENT DOCUMENTS

| | | | | |
|---|---|---|---|---|
| CH | 128945 | * | 11/1928 | 5/117 |
| FR | 1108362 | * | 1/1956 | 5/117 |
| FR | 1256729 | * | 2/1961 | 5/112 |
| FR | 1256756 | * | 2/1961 | 5/112 |
| GB | 107670 | * | 7/1917 | 5/112 |
| GB | 228517 | * | 5/1925 | 5/117 |
| GB | 360670 | * | 11/1931 | 5/117 |

* cited by examiner

*Primary Examiner*—Robert G. Santos

(57) ABSTRACT

A folding bed frame has a pair of support tubes, two pairs of connection tubes, three pairs of leg sets, a plurality of positioning devices, a plurality of connection bars, a plurality of angle plates, and a plurality of T-shaped plates. Each leg set has a generally S-shaped rod, the generally S-shaped rod having a lower portion, a middle portion and an upper portion, a curved rod disposed on the middle portion of the generally S-shaped rod, a leg rod having an upper end disposed on a bottom of the middle portion of the generally S-shaped rod, and two of the connection bars connected to one of the curved rods, one of the generally S-shaped rods, and one of the leg rods. Two angle plates are connected to one curved rod and one connection tube. Two T-shaped plates are connected to one curved rod and two connection tubes. Each positioning device is disposed in the corresponding connection tube to position the corresponding connection tube and the corresponding support tube.

4 Claims, 8 Drawing Sheets

FOLDING BED FRAME

BACKGROUND OF THE INVENTION

The present invention relates to a folding bed frame. More particularly, the present invention relates to a folding bed frame which has a positioning device to be operated easily.

A conventional folding bed frame has a pair of X-shaped leg sets. When a user sits on the conventional folding bed frame, the X-shaped leg sets will be extended to the utmost. The conventional folding bed frame has a plurality of connecting tubes having positioning devices to position the connecting tubes. However, the positioning devices cannot be contracted so that it is difficult to assemble the connecting tubes.

SUMMARY OF THE INVENTION

An object of the present invention is to provide a folding bed frame which has a generally S-shaped rod, a curved rod disposed on the generally S-shaped rod, and a leg rod disposed on a bottom of the generally S-shaped rod to form two generally U-shaped configurations so that a leg set will be extended stably.

Another object of the present invention is to provide a folding bed frame which has a positioning device to be operated easily so that a support tube and a connection tube are assembled easily.

Accordingly, a folding bed frame comprises a plurality of support tubes, a plurality of connection tubes, a plurality of leg sets, a plurality of positioning devices, a plurality of connection bars, a plurality of angle plates, and a plurality of T-shaped plates. Each of the leg sets has a generally S-shaped rod, the generally S-shaped rod having a lower portion, a middle portion and an upper portion, a curved rod disposed on the middle portion of the generally S-shaped rod, a leg rod having an upper end disposed on a bottom of the middle portion of the generally S-shaped rod, and two of the connection bars connected to one of the curved rods, one of the generally S-shaped rods, and one of the leg rods. Two of the angle plates are connected to one of the curved rods and one of the connection tubes. Two of the T-shaped plates are connected to one of the curved rods and two of the connection tubes. Each of the connection tubes has an end opening. Each of the positioning devices is disposed in the corresponding connection tube to position the corresponding connection tube and the corresponding support tube.

DETAILED DESCRIPTION OF THE INVENTION

Figure 1:
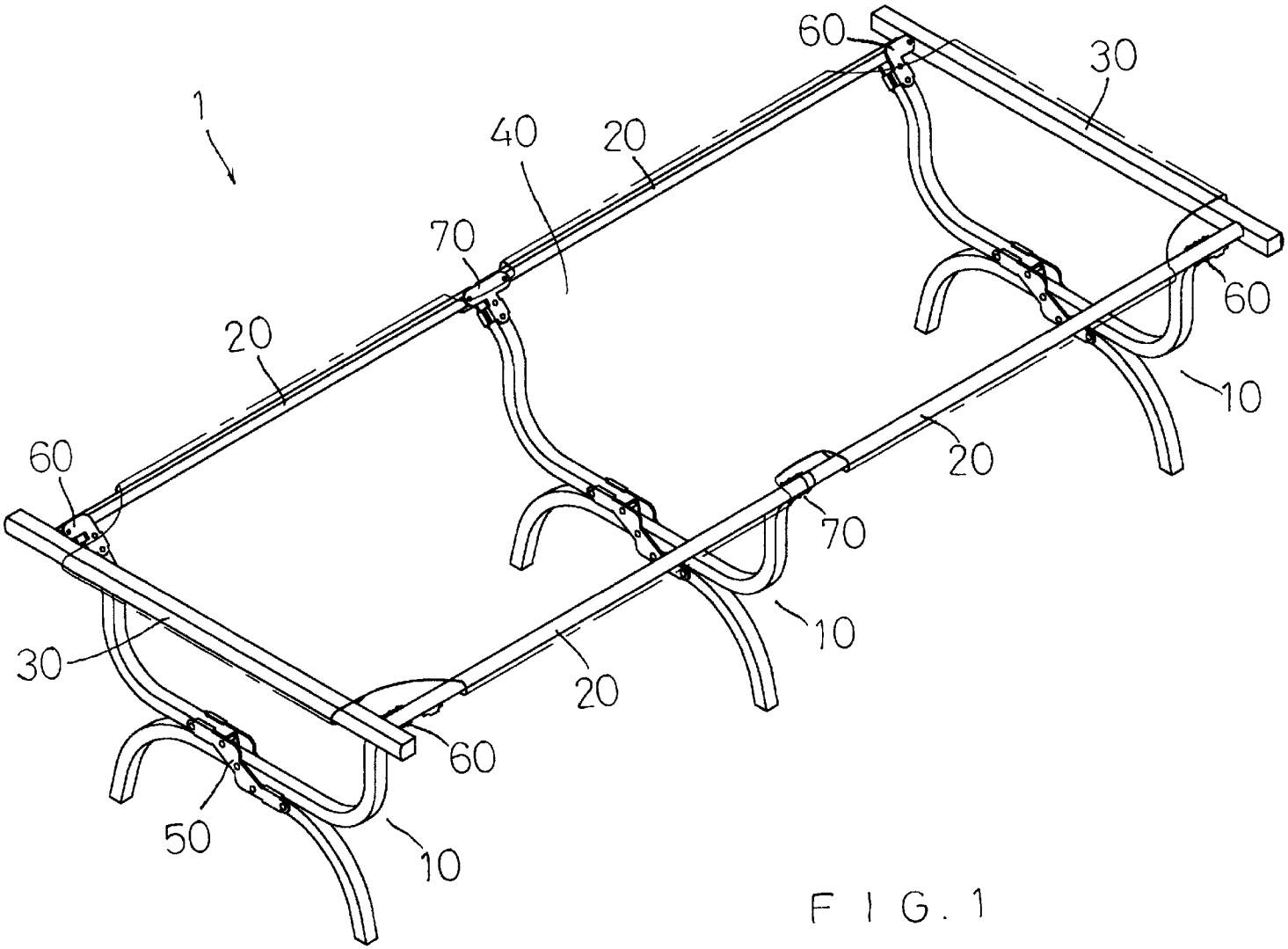
FIG. 1 is a perspective assembly view of a folding bed frame of a preferred embodiment in accordance with the present invention.
Figure 2:
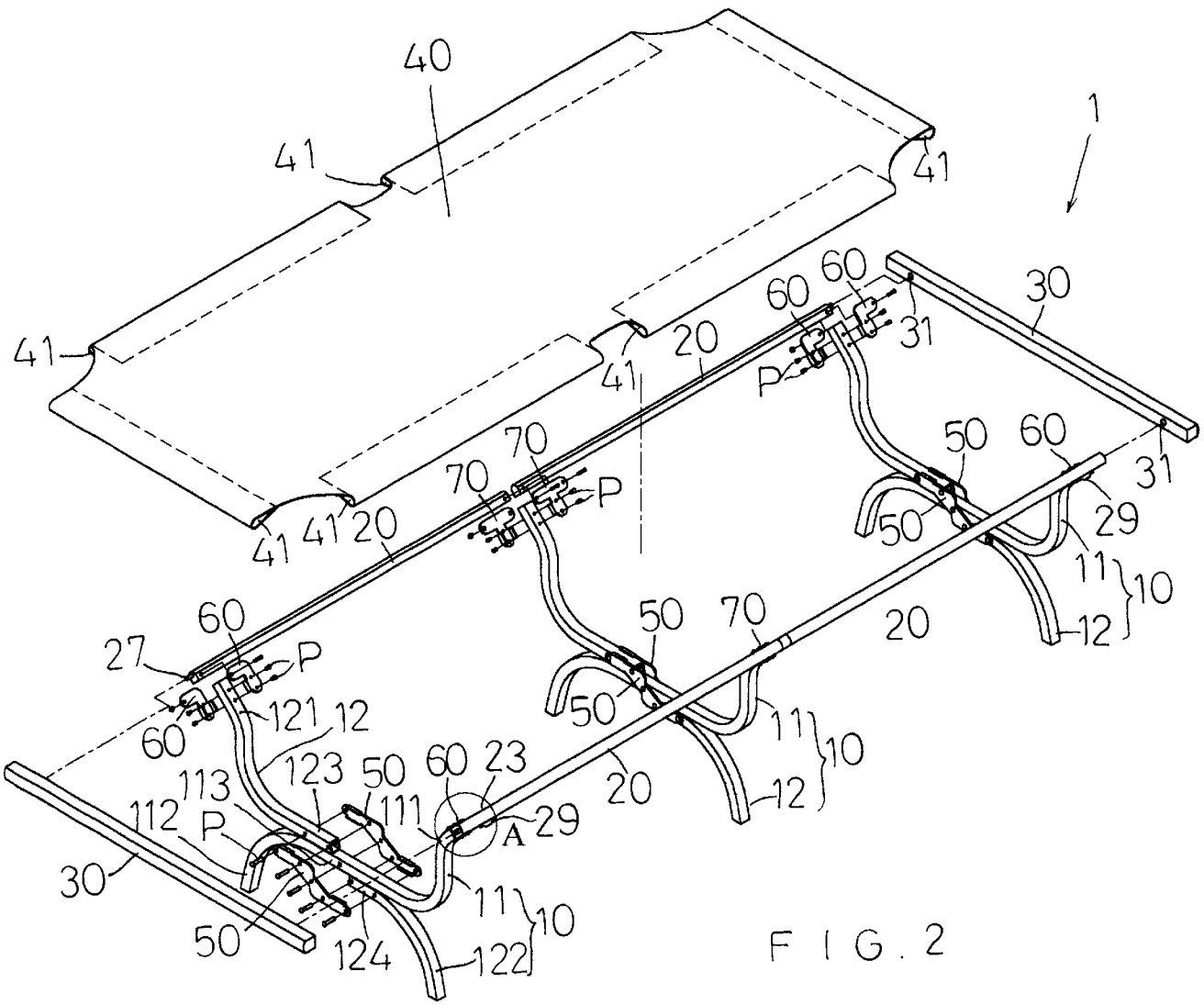
FIG. 2 is a perspective exploded view of a folding bed frame of a preferred embodiment in accordance with the present invention.
Figure 2A:
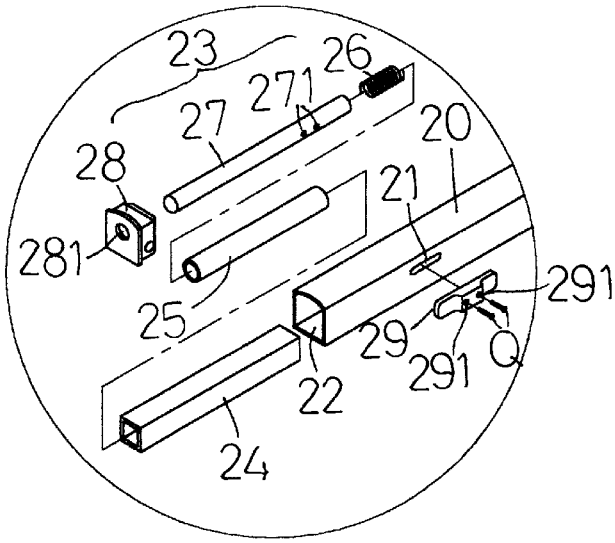
FIG. 2A is a perspective exploded view of a positioning device and a connection tube.
Figure 4:
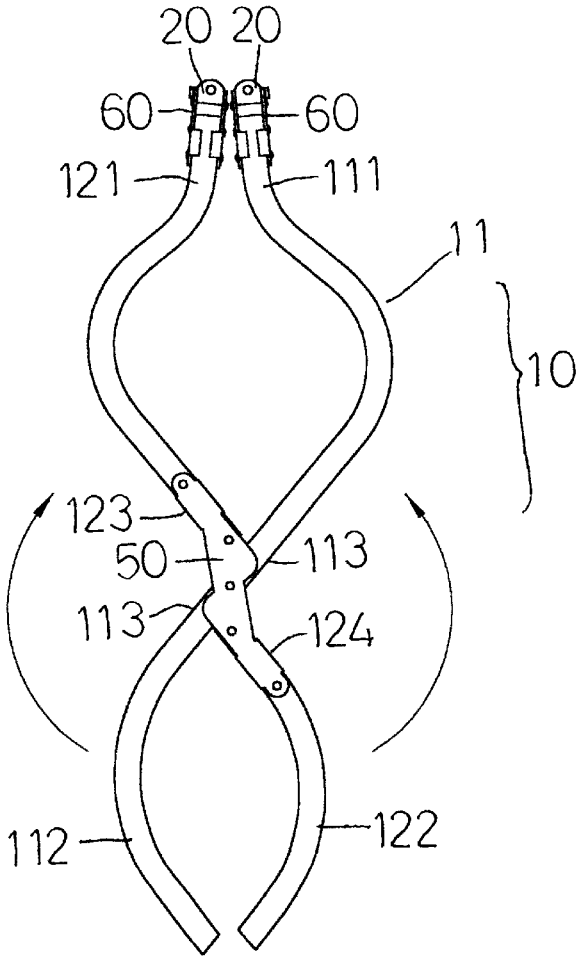
FIG. 4 is an elevational schematic view illustrating a leg set of a folding bed frame of a preferred embodiment is folded.
Figure 3:
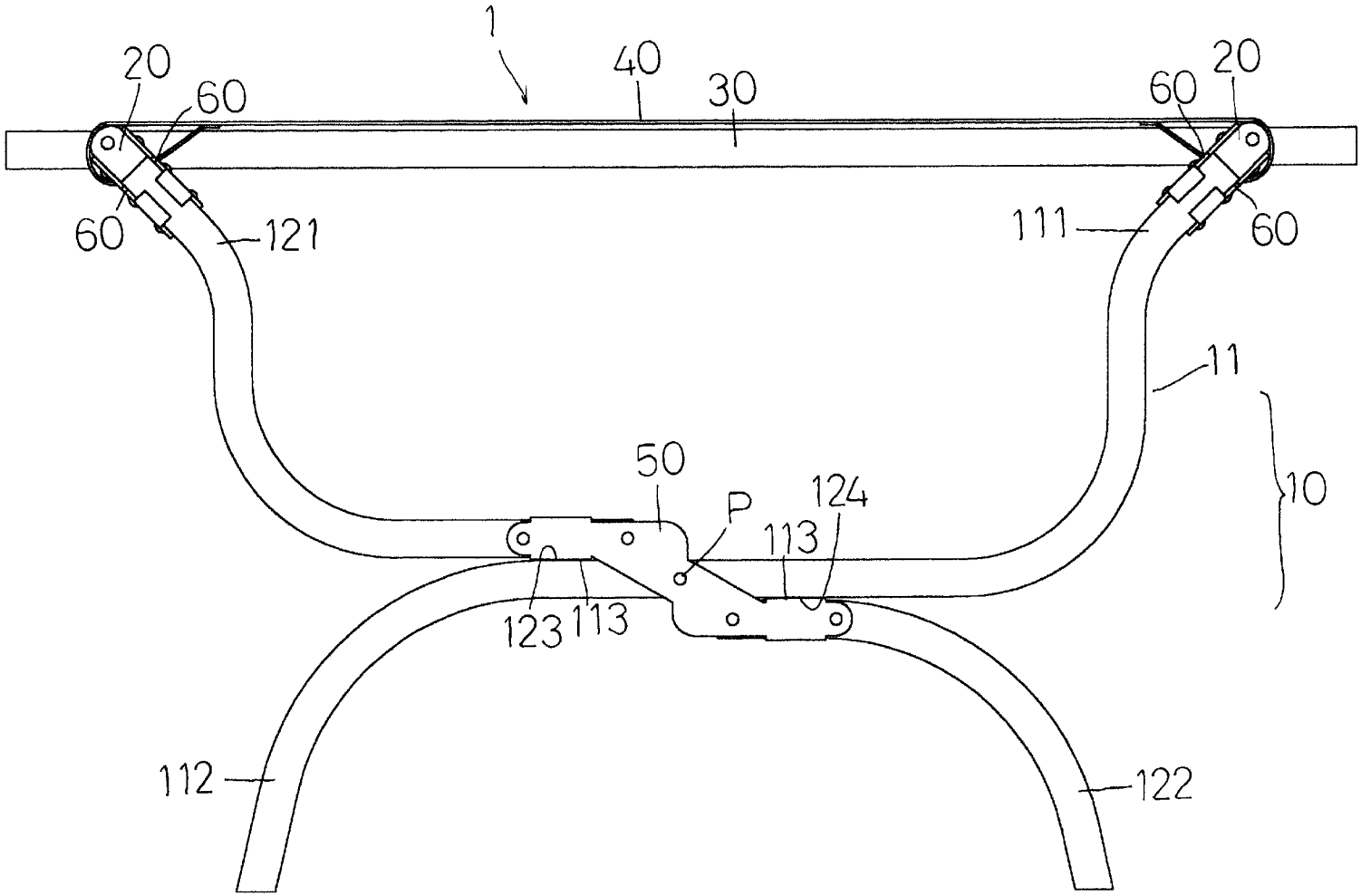
FIG. 3 is an elevational schematic view illustrating a folding bed frame of a preferred embodiment is extended.
Figure 5:
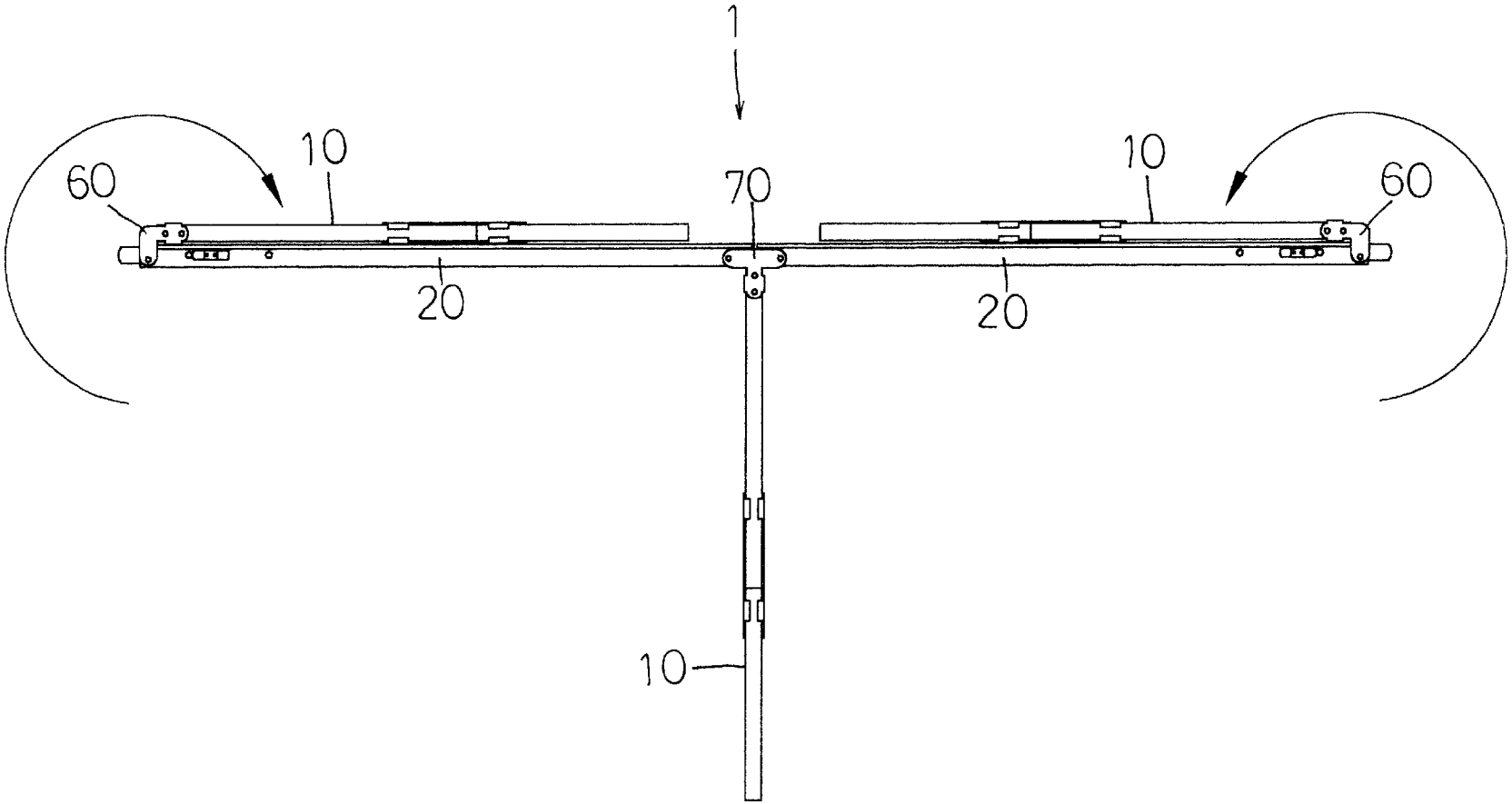
FIG. 5 is an elevational schematic view illustrating a folding bed frame of a preferred embodiment is folded.
Figure 6:
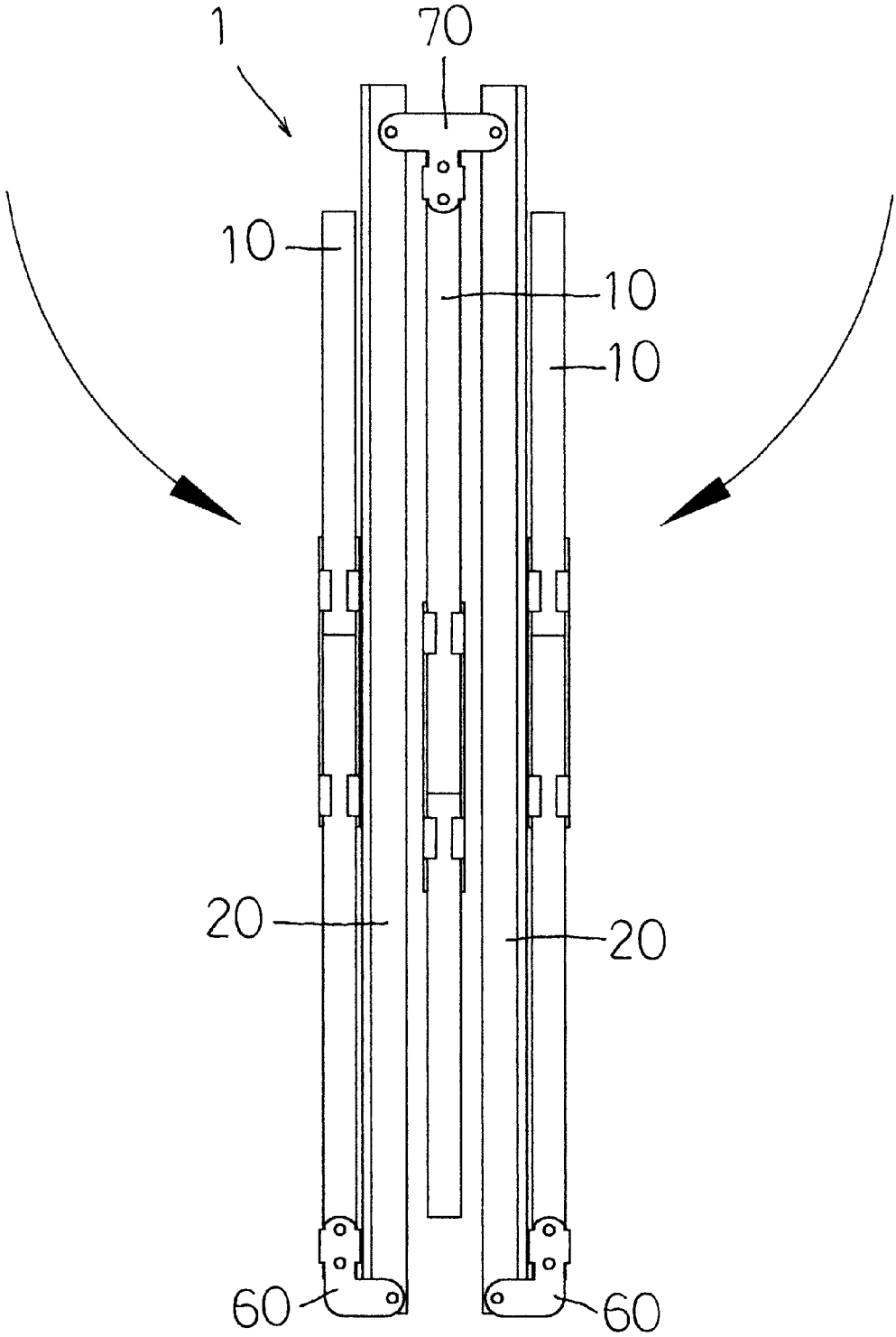
FIG. 6 is a schematic view illustrating a folding bed frame of a preferred embodiment is folded into a compact configuration.
Figure 7:
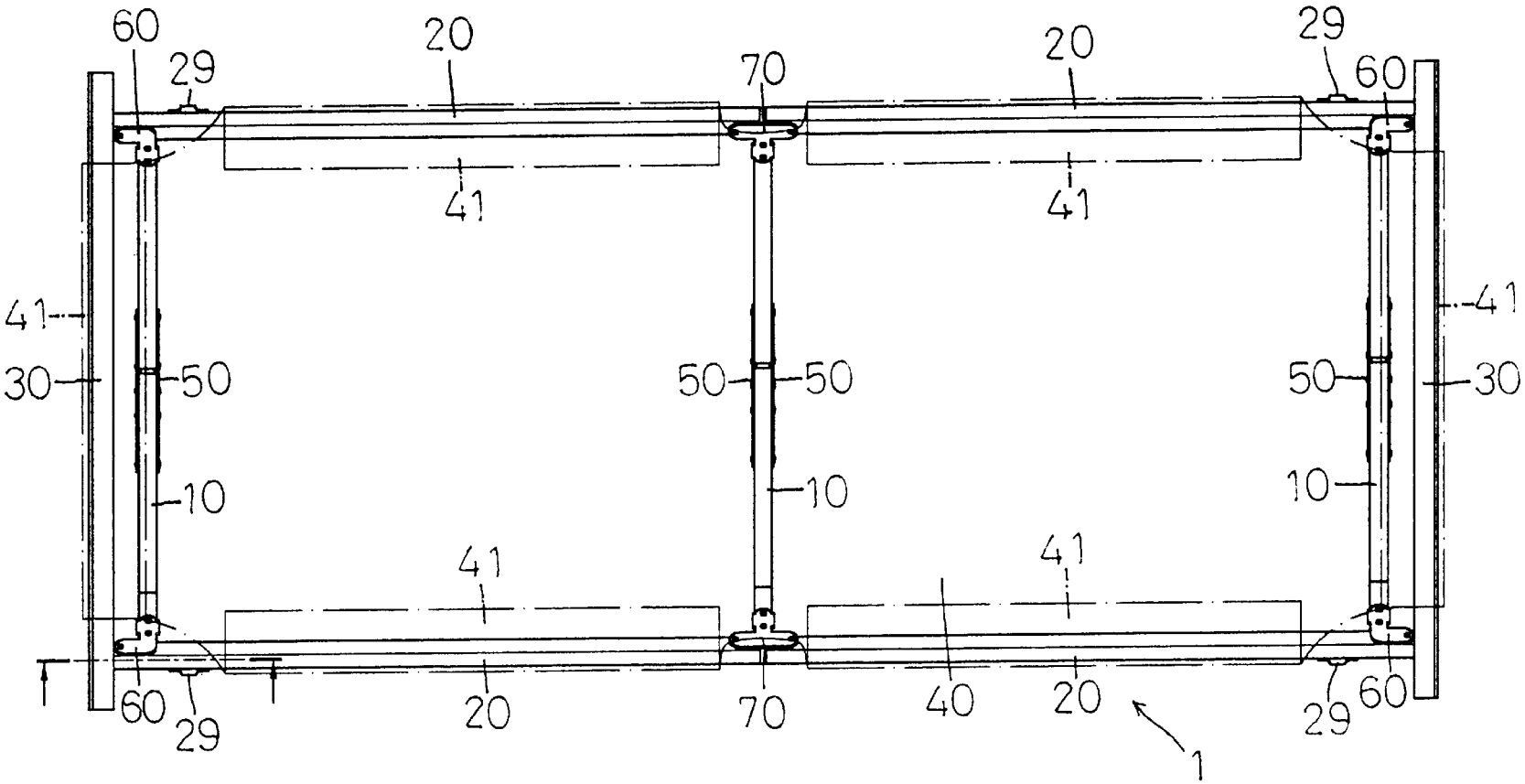
FIG. 7 is an elevational view of a folding bed frame of a preferred embodiment in accordance with the present invention.
Figure 7A:
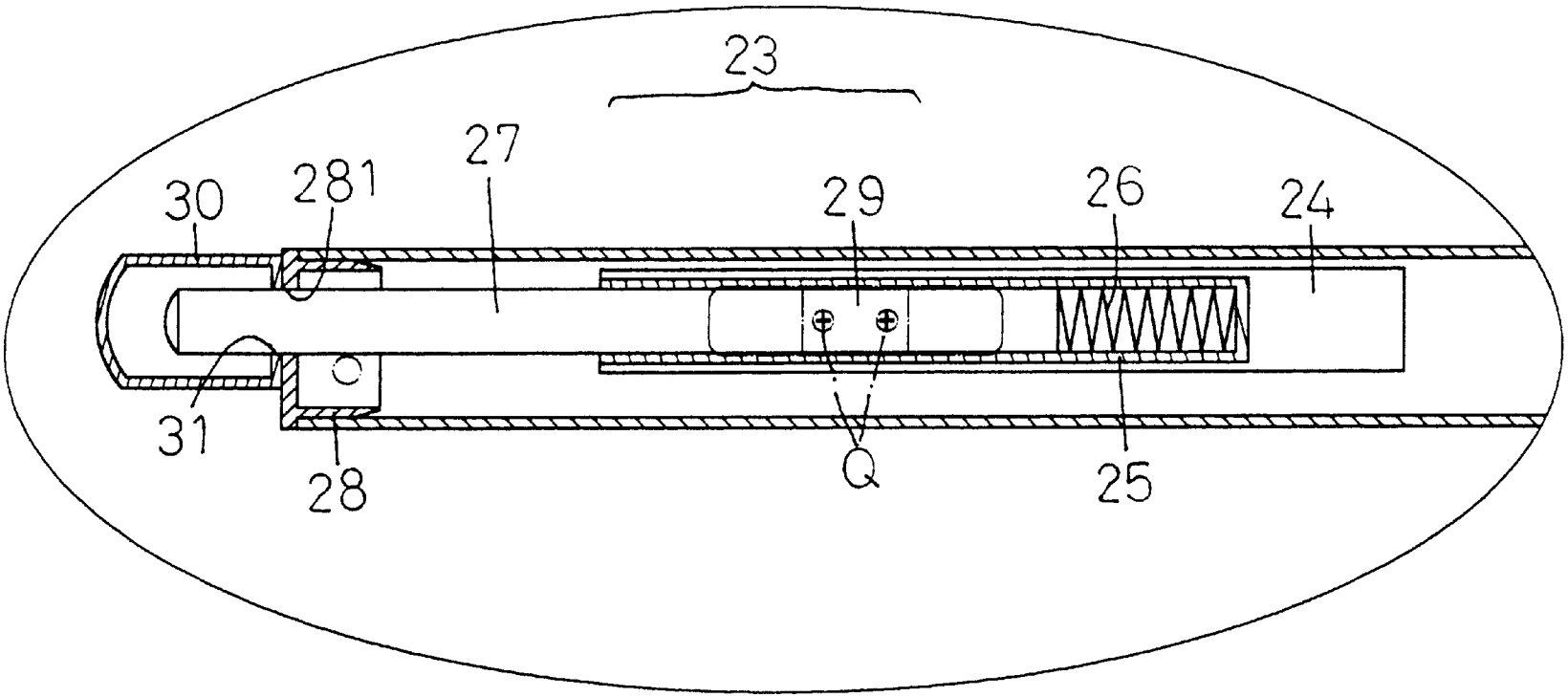
FIG. 7A is a partially sectional view of a folding bed frame of a preferred embodiment in accordance with the present invention.

Referring to FIGS. 1 to 7A, a folding bed frame 1 comprises a pair of support tubes 30, two pairs of connection tubes 20, three pairs of leg sets 10, a plurality of positioning devices 23, a plurality of connection bars 50, a plurality of angle plates 60, and a plurality of T-shaped plates 70.

Each of the leg sets 10 has a generally S-shaped rod 11, the generally S-shaped rod 11 having a lower portion 112, a middle portion 113 and an upper portion 111, a curved rod 12 disposed on the middle portion 113 of the generally S-shaped rod 1, a leg rod 122 having an upper end 124 disposed on a bottom of the middle portion 113 of the generally S-shaped rod 11, and two of the connection bars 50 connected to one of the curved rods 12, one of the generally S-shaped rods 11, and one of the leg rods 122.

Two of the angle plates 60 are connected to one of the curved rods 12 and one of the connection tubes 20.

Two of the T-shaped plates 70 are connected to one of the curved rods 12 and two of the connection tubes 20.

Each of the connection tubes 20 has an oblong slot 21 and an end opening 22.

Each of the positioning devices 23 is disposed in the corresponding connection tube 20 to position the corresponding connection tube 20 and the corresponding support tube 30.

Each of the support tubes 30 has a pair of circular holes 31, and each of the circular holes 31 receives the corresponding positioning device 23.

Each of the positioning devices 23 has a square tube 24 inserted in the corresponding connection tube 20, a round pipe 25 inserted in the square tube 24, a pin 27 having a pair of threaded apertures 271, a spring 26 enclosing the pin 27, the spring 26 and the pin 27 inserted in the round pipe 25, and a cover block 28 covering the end opening 22 of the corresponding connection tube 20.

The cover block 28 has a through hole 281.

The pin 27 is inserted through the through hole 281 of the cover block 28.

A button 29 has a pair of through apertures 291.

Two screws Q pass through the through apertures 291 of the button 29, the oblong slot 21 of the connection tube 20, and the threaded apertures 271 of the pin 27.

The curved rod 12 has an upper part 121 and a lower part 123.

A plurality of first rivets P fasten two of the connection bars 50, one of the curved rods 12, one of the generally S-shaped rod 11, and one of the leg rod 122 together.

A plurality of second rivets P fasten two of the angle plates 60, one of the curved rods 12, and one of the connection tubes 20 together.

A plurality of third rivets P fasten two of the T-shaped plates 70, one of the curved rods 12, and two of the connection tubes 20 together.

A fabric 40 has a plurality of periphery holes 41 to receive the support rods 30 and the connection rods 20.

The generally S-shaped rod 11, the curved rod 12, and the leg rod 122 will form two generally U-shaped configurations so that the leg set 10 will be extended stably.

When the button 29 is moved along the oblong slot 21 of the connection tube 20, the pin 27 is moved also.

When the pin 27 is moved inward, the support rod 30 is detached from the connection rod 20.

The invention is not limited to the above embodiment but various modification thereof may be made. Further, various changes in form and detail may be made without departing from the scope of the invention.

I claim:

1. A folding bed frame comprises:

a plurality of support tubes, a plurality of connection tubes, a plurality of leg sets, a plurality of positioning devices, a plurality of connection bars, a plurality of angle plates, and a plurality of T-shaped plates, each of the leg sets having a generally S-shaped rod, the generally S-shaped rod having a lower portion, a middle portion and an upper portion, a curved rod disposed on the middle portion of the generally S-shaped rod, a leg rod having an upper end disposed on a bottom of the middle portion of the generally S-shaped rod, and two of the connection bars connected to one of the curved rods, one of the generally S-shaped rods, and one of the leg rods, two of the angle plates connected to one of the curved rods and one of the connection tubes, two of the T-shaped plates connected to one of the curved rods and two of the connection tubes, each of the connection tubes having an end opening, and each of the positioning devices disposed in the corresponding connection tube to position the corresponding connection tube and the corresponding support tube.

2. The folding bed frame as claimed in claim 1, wherein each of the support tubes has a pair of circular holes, and each of the circular holes receives the corresponding positioning device.

3. The folding bed frame as claimed in claim 1, wherein each of the connection tubes further has an oblong slot.

4. The folding bed frame as claimed in claim 3, wherein each of the positioning devices has a square tube inserted in the corresponding connection tube, a round pipe inserted in the square tube, a pin having a pair of threaded apertures, a spring enclosing the pin, the spring and the pin inserted in the round pipe, and a cover block covering the end opening of the corresponding connection tube, the cover block has a through hole, the pin is inserted through the through hole of the cover block, a button has a pair of through apertures, and two screws pass through the through apertures of the button, the oblong slot of the connection tube, and the threaded apertures of the pin.

* * * * *